United States Patent [19]

Graciet et al.

[11] Patent Number: 4,460,624

[45] Date of Patent: Jul. 17, 1984

[54] PROCESS FOR THE MANUFACTURE OF THICK LAYER VARISTORS ON A HYBRID CIRCUIT SUBSTRATE

[75] Inventors: Michel Graciet; Annick Romann; François Buchy, all of Paris, France

[73] Assignee: Thomson-CSF, Paris, France

[21] Appl. No.: 413,552

[22] Filed: Aug. 31, 1982

[30] Foreign Application Priority Data

Sep. 4, 1981 [FR] France ..... 81 16872

[51] Int. Cl.[3] ..... H01C 7/12

[52] U.S. Cl. ..... 427/102; 427/103; 427/282; 427/376.2; 338/21; 338/307; 338/308; 338/309

[58] Field of Search ..... 338/21, 307, 308, 309; 252/518; 427/101, 102, 103, 282, 376.2

[56] References Cited

U.S. PATENT DOCUMENTS

| | | | |
|---|---|---|---|
| 3,598,762 | 8/1971 | Futaki et al. | 252/518 |
| 3,622,523 | 11/1971 | Amin et al. | 252/518 |
| 3,670,221 | 6/1972 | Hamamoto et al. | 338/21 |
| 3,725,836 | 4/1973 | Wada et al. | 338/21 |
| 3,836,340 | 9/1974 | Conwicke | 252/512 |
| 3,839,231 | 10/1974 | Patterson et al. | 252/518 |
| 3,916,366 | 10/1975 | Jefferson | 338/21 |
| 4,041,436 | 8/1977 | Kouchich et al. | 252/519 |
| 4,333,861 | 6/1982 | Aoki et al. | 338/21 |

FOREIGN PATENT DOCUMENTS 2719602 1/1979 Fed. Rep. of Germany ..... 338/21

*Primary Examiner*—Michael R. Lusignan
*Assistant Examiner*—Richard Bueker
*Attorney, Agent, or Firm*—Oblon, Fisher, Spivak, McClelland & Maier

[57] ABSTRACT

The invention relates to a process for the manufacture of non-linear resistors (varistors) from thick-layer ceramic material, in particular on a hybrid circuit substrate, or any other device requiring that a predetermined temperature should not be exceeded during its manufacture.

According to the invention, after crushing a ceramic material in order to obtain a very fine powder of varistor material, a powder is produced of conductive or semiconductive material able to assume the pasty state at a temperature lower than 850° C. and a binder is incorporated therein to obtain a screen printing paste. The layer deposited by screen printing on a substrate such as glass, is dried and then heat treated so as to assure cohesion of the layer. This layer is either inserted between a previously deposited electrode and another electrode, or covered by two separate electrodes. The invention is particularly applicable to matrix access display screens.

6 Claims, No Drawings

PROCESS FOR THE MANUFACTURE OF THICK LAYER VARISTORS ON A HYBRID CIRCUIT SUBSTRATE

BACKGROUND OF THE INVENTION

The invention relates to a process for the manufacture of non-linear resistors, normally referred to as varistors, produced from a ceramic substance comprising a thick layer, in particular on a hybrid circuit substrate, or a device requiring that a predetermined temperature should not be exceeded during manufacture, which is particularly the case for matrix access display screens (The varistor deposit substrate then being glass).

It is known that there is a small number of materials which have non-linear electrical resistance properties and of which the voltage-current characteristics are given by the relationship:

$$I=(V/C)^{\alpha}$$

where V is the voltage across points separated by a body formed by the material in question, I is the intensity of the current flowing between the two points, C is a constant and the non-linearity factor $\alpha$ is an exponent exceeding 1.

Varistors are known which are produced in the form of discrete components, the most frequently used being polycrystalline ceramic resistors produced from a metal oxide with small quantities of one or more metal oxides or metal salts. By way of example, the major proportion of metal oxide is zinc oxide with small quantities of oxide of bismuth, antimony, cobalt, chromium and manganese. To secure high non-linearity coefficients, it is known that it is necessary for these substances to be sintered at temperatures exceeding 1000° C.

However, in hybrid circuit technology, it is of interest to produce the resistors, no longer as discrete components, but in the form of deposits applied by screen printing, that is to say in thick layers. In this case, the nature of the substrate of the hybrid circuit already covered, at the time of screen printing, with electrodes which are non refractory at high temperatures, prevents the utilisation of standard processes for the production of such varistors. Recourse is consequently had to a technique of preliminary sintering of the material at 1100° C. followed by the crushing of this material to obtain a polycrystalline powder which acts as a raw material for deposition by screen printing. The French patent application published under the No. 2,315,772 in particular discloses a process for the production of varistors in the form of a thick layers, characterised in that it consists in:

- initially producing a varistor in the form of a ceramic element;
- crushing this ceramic element to a grain size smaller than 3 microns;
- mixing the powder thus obtained with a pulverulent glass frit of the same granulometry and incorporating an organic binder in the mixture to obtain a paste applicable by screen printing;
- applying this paste in a thick layer by screen printing an a dielectric substrate;
- baking the paste at a temperature comprised between 650° C. and 1100° C. depending on the desired non-linearity characteristics for the thick-layer varistor.

This process has two disadvantages:

(1) The non-linearity coefficients are low, commonly well below 10;

(2) The low-voltage electrical insulation is poor in most cases, in particular because of the lack of adhesion between the grains and between these and the substrate. This latter disadvantage may be avoided by utilising the process of the West German patent published under the No. 2,375,484, in which higher temperatures than 1100° C. are utilised, but this then requires utilisation of a refractory substrate like alumina, which is precisely what it is desired to avoid in the present case.

The invention has as its object to avoid these disadvantages whilst making the thick-layer varistor production process compatible with the utilisation of non-refractory supports.

SUMMARY OF THE INVENTION

The process according to the invention comprises preliminary stages for the manufacture of a varistor in the form of a ceramic body and the crushing of this ceramic body into grains of homogenous and controlled size, for example of the order of three microns. It is characterised in that it also comprises the following steps:

(a) Preparation of a powder formed by a conductive or semiconductive material having a conductivity comprised between $10^{-8}$ ohm.cm and $10^{6}$ ohm.cm, able to assume the liquid state or a pasty state at a predetermined temperature lower than 850° C.;

(b) Preparation of a screen-printing paste comprising 40 to 90% by weight of ceramic grains obtained during the initial stages, 10 to 30% by weight of the powder obtained during the preceding step (a), the remainder being constituted, as regards at least 10% by weight, by an organic binder of the kind utilised in screen printing;

(c) depositing the paste thus obtained, for example by screen printing, on a substrate initially provided by screen printing for example with an electrode forming the first electrode of the thick-layer varistor, and baking the deposit if it had been produced by screen printing;

(d) completing the varistor, by depositing a second electrode, for example by screen printing, over the deposit produced during the preceding step (c) and baking this latter electrode.

In a modified form of the invention, the electrodes are not deposited until the step (d) on two separate positions of the thick-layer varistor deposit.

During step (a), the conductive or semiconductive material may be a semiconductive glass and may in particular contain vanadium oxide in a percentage proportion of 50 to 90% in mols.

DETAILED DESCRIPTION OF THE INVENTION

A clearer understanding of the invention will be gained from the following examples:

First Example

The powder produced during the preliminary stages is formed by crystallites or pieces of crystallites of a ceramic material which, before sintering, contains the following in mols.:

97% of ZnO,
0.5% of CoO,
0.5% of $Bi_2O_3$, 0.5% of $Mn_2O_3$,
0.5% of $Ni_2O_3$,
1% of $Sb_2O_3$.

The sintering temperature of the intitial ceramic material is comprised between 1050° C. and 1350° C.

During step (a) a powder is prepared containing 50 to 90% in mols. of vanadium oxide ($V_2O_5$) and 10 to 50% in mols. of sodium metalphosphate ($NaPO_3$). The powder obtained by mixing the raw materials and crushing by a conventional method has its temperature raised to 950° C. for four hours and is then poured on a slab at 100° C. The deposit thus formed is crushed into a fine powder. This powder is exposed to heat treatment for between half an hour to two hours at a temperature comprised between 200° C. and 400° C. in order to increase its electrical conductivity. The resistivity of the grains of powder should be comprised between 1 and 1000 ohms.cm.

During step (b) a mixture is produced comprising 40 to 90% by weight of the powder obtained at the end of the preliminary steps, 20 to 30% by weight of the powder obtained during step (a), and 10 to 40% of organic binder. This binder is produced from 170 g of nitrocellulose mixed with a sufficient quantity of butoxyacetate to obtain a volume of two and a half liters, whilst causing this latter volume to vary according to the viscosity required.

During step (c), an insulating substrate is selected, for example formed by a very pure borosilicate glass (less than 0.2% of alcaline ions in the case of the glass bearing the trade name Corning No. 7059). A first electrode of the thick-layer varistor is deposited by screen printing on this substrate by making use of a nickel screen printing ink, for example the paste bearing the trade name "nickel T 9197 Engelhardt". This deposit is treated at 520° C. for ten minutes.

After this, the paste prepared during step (b) is deposited over the electrode, and drying of this paste is performed at 120° C. to eliminate the binder, followed by sintering at 580° C. for 10 minutes.

During step (d) a second electrode is deposited by screen printing by making use of a gold screen printing ink, for example the paste bearing the trade name "gold 6394 Engelhardt". This second electrode is heat treated like the first.

The following result was observed upon depositing a layer of thirty microns by screening printing during step (c). The current intensity amounted to 10 mA/cm$^2$, for a voltage of 32 volts. The non-linearity coefficient measured between 1 and 10 mA is of the order of 28.

Second Example

The powder produced during the preliminary stages is identical to that of the first example. The powder prepared during step (b) is analogous to that of the first example, except that the sodium phosphate is replaced by potassium phosphate. For this reason, the sintering temperature of step (c) is 520° C., the period of heat treatment being identical.

As for the result obtained, the current measured under conditions similar to those of the first example, is 10 mA for a voltage of 28 volts, the non-linearity coefficient measured between 1 and 10 mA being of the order of 37.

Third Example

The powder produced during the preliminary stages is identical to that of the first example. The same applies for the powder produced during step (b). However, substrate of step (c) is alumina coated with a silver electrode deposited by screen printing and treated at 850° C. During step (d) a silver lacquer or varnish is deposited, which is treated at 250° C. for ten minutes.

As regards the result obtained, the current measured under similar conditions to those of the first example, is 10 mA for a voltage of 50 volts, the non-linearity factor measured between 1 and 10 mA being of the order of 16.

Fourth Example

The preliminary stages, as well as steps (a) and (b) are identical to those of the first example. However, in step (c) the thick layer of 30 microns forming the varistor is first deposited by screen printing directly on the glass substrate, followed by the two electrodes each of which covers a part of the thick layer, after the latter has been sintered. A space of 1/10th of a mm, for example, is left between the electrodes. Both electrodes are formed from the same gold paste specified for the second electrode in the first example.

For electrodes facing each other over a length of 1 cm and spaced apart by 1/10th of a mm, a current of 1 mA is measured for a voltage of 112 volts. The non-linearity coefficient measured between 0.1 and 1 mA is of the order of 12.

The variations of the manufacturing processes illustrated by the 1st, 2nd and 4th examples are equally applicable in the case of an alumina substrate.

The varistors produced by the process of the invention are of two main types:

a type in which the thick layer of non-linear resistance material is inserted between two input and output electrodes, a type in which the thick layer of the same material is covered on two separate portions of its surface with input and output electrodes.

What is claimed is:

1. A process for manufacturing varistors comprising forming a varistor in the form of a ceramic body containing at least 97% ZnO, then crushing this ceramic body into a first ceramic powder and then:

preparing a second binder powder formed by a conductive or semiconductive glass having a conductivity between $10^{-8}$ ohm.cm and $10^6$ ohms.cm, capable of assuming a liquid state or a pasty state at a temperature lower than 850° C.;

(b) preparing a silk-screen printing paste comprising 40 to 90% by weight of the first ceramic powder, 10 to 30% by weight of the second binder powder, the remainder being at least 10% by weight of an organic binder of a kind utilized in silk-screen printing;

(c) depositing the paste thus obtained on a non-refractory substrate by silk-screen printing, the substrate being first provided with an electrode forming the first electrode of the varistor and baking at a temperature of 850° C. or less; and (d) completing the varistor by depositing two access electrodes by silk-screen printing on opposite faces of the varistor;

said varistor having a non-linearity coefficient of greater than 10.

2. The process of claim 1 wherein said semiconductive glass comprises 50 to 90% in moles of $V_2O_5$.

3. The process according to claim 1 wherein preparing said binder powder in step (a) comprises mixing 50 to 90% in moles of $V_2O_5$ and 10 to 50% in moles of sodium or potassium metaphosphate, followed by heating to 950° C. for four hours, then casting on a plate at 100° C. to form a deposit, then crushing the deposit thus obtained into a fine powder, then heat treating the powder thus obtained for half an hour to two hours at a temperature between 200° C. and 400° C. and in step (b) forming said paste comprises mixing 50 to 90% by weight of the first ceramic powder, 20 to 30% by weight of the second binder powder and 10 to 40% of the organic binder of the type used in silk-screen printing.

4. The process according to claim 1, wherein said non-refractory substrate in step (c) is a glass substrate and said step (c) further comprises depositing on said glass substrate a first electrode from a nickel ink, then subjecting said substrate to heat treatment for ten minutes at 520° C., then depositing the paste obtained in step (b) in a thick layer by silk-screen printing on the first electrode, then drying said layer at 120° C. and sintering at a temperature between 520° C. and 580° C. for ten minutes, and then finally depositing a gold electrode on said layer.

5. The process according to claim 1, wherein said non-refractory substrate in step (c) is an alumina substrate and said step (c) further comprises depositing a first electrode formed from a silver ink on said alumina substrate, then subjecting this electrode to a heat treatment at 850° C., then depositing the paste obtained in step (b) in a thick layer by silk-screen printing on the first electrode, then drying this layer at 120° C. then sintering at a temperature between 520° C. and 580° C. for ten minutes, then finally depositing a silver lacquer on this layer and treating at 250° C. for ten minutes.

6. The process according to claim 2, further comprising depositing during step (c) the paste obtained in step (b) by silk-screen printing directly on the substrate, then drying this layer at 120° C. then sintering at a temperature between 520° C. and 580° C. for ten minutes, then finally depositing a gold ink on two distinct parts of this layer and treating for ten minutes at 520° C.

* * * * *